US005297516A

United States Patent [19]

Hara

[11] Patent Number: 5,297,516

[45] Date of Patent: Mar. 29, 1994

[54] VALVE ACTUATING APPARATUS

[75] Inventor: Seinosuke Hara, Kanagawa, Japan

[73] Assignee: Atsugi Unisia Corporation, Kanagawa, Japan

[21] Appl. No.: 965,071

[22] Filed: Oct. 22, 1992

[30] Foreign Application Priority Data

Oct. 23, 1991 [JP] Japan ..... 3-275617
Jan. 10, 1992 [JP] Japan ..... 4-3100

[51] Int. Cl.[5] ..... F01L 1/34

[52] U.S. Cl. ..... 123/90.16; 123/90.22

[58] Field of Search ..... 123/90.15, 90.16, 90.17, 123/90.22, 90.39, 90.4, 90.41, 90.44, 198 F

[56] References Cited

U.S. PATENT DOCUMENTS

| | | | |
|---|---|---|---|
| 4,151,817 | 5/1979 | Mueller | 123/90.16 |
| 4,203,397 | 5/1980 | Soeters, Jr. | 123/90.16 |
| 4,762,096 | 8/1988 | Kamm et al. | 123/90.16 |
| 4,768,467 | 9/1988 | Yamada et al. | 123/90.16 |
| 4,768,475 | 9/1988 | Ikemura | 123/90.16 |
| 4,844,023 | 7/1989 | Konno et al. | 123/90.16 |
| 5,020,488 | 6/1991 | Watanabe | 123/90.16 |
| 5,046,462 | 9/1991 | Matayoshi et al. | 123/90.16 |
| 5,085,182 | 2/1992 | Nakamura et al. | 123/90.16 |

FOREIGN PATENT DOCUMENTS

| | | |
|---|---|---|
| 0420159 | 4/1991 | European Pat. Off. . |
| 2753197 | 6/1978 | Fed. Rep. of Germany . |
| 63-57806 | 3/1988 | Japan . |
| 63-167016 | 7/1988 | Japan . |
| 9112415 | 8/1991 | PCT Int'l Appl. . |

*Primary Examiner*—E. Rollins Cross
*Assistant Examiner*—Weilun Lo
*Attorney, Agent, or Firm*—Bachman & LaPointe

[57] ABSTRACT

An apparatus for actuating valves of an engine is disclosed. A cam shaft is supported by the engine and has at least one set of cams, e.g., two axially spaced low speed cams and a high speed cam between the low speed cams. A rocker shaft is supported by the engine. The rocker shaft supports a rocker arm for the valves. The rocker arm is driven by the low speed cams. The rocker arm has a sub-rocker shaft and a pin. A free cam follower is supported by the sub-rocker shaft and driven by the high speed cam. The apparatus comprises a mechanism including a lever supported by the pin of the rocker arm. The lever has a first position wherein the lever and the free cam follower are joined for attaining unitary motion of the free cam follower with the rocker arm. The lever has a second position wherein the lever and the free cam follower are separated for allowing relative motion of the free cam follower with respect to the rocker arm. The mechanism includes a hydraulic piston for urging the lever to the first position.

26 Claims, 7 Drawing Sheets

VALVE ACTUATING APPARATUS

RELATED APPLICATIONS

U.S. patent application Ser. No. 07/873,362 filed on Apr. 24, 1992, now U.S. Pat. No. 5,183,015, by Shoji MORITA et al.;

German Patent Application No. P4213865.5 filed on Apr. 27, 1992 by ATSUGI UNISIA CORPORATION;

British Patent Application No. 9209099.2 filed on Apr. 27, 1992 by ATSUGI UNISIA CORPORATION.

BACKGROUND OF THE INVENTION

The present invention relates to an apparatus for actuating valves of an engine.

Japanese Patent Application First (unexamined) Publications Nos. 63-57806 and 63-167016 disclose a valve actuating apparatus. The known valve actuating apparatus comprises a mechanism to releasably interconnect the adjacent two cam operated rocker arms. The rocker arms are formed with mating bores receiving a plunger. The plunger is movable between a first position in which the plunger is disposed in one of the mating bores and a second position in which the plunger is inserted into the other plunger and thus disposed in both of the mating bores. When the plunger is in the first position, the two rocker arms move separately, while when the plunger is in the second position, they move as a unit.

This mechanism using the plunger and mating bores, however, requires high degree of precision in forming the mating bores and the plunger.

An object of the present invention is to provide a valve actuating apparatus which does not use a plunger nor bores which demand high degree of precision to form.

SUMMARY OF THE INVENTION

According to the present invention, there is provided an apparatus for actuating valves of an engine, comprising:

a cam shaft with at least one set of cams;

a rocker shaft;

a rocker arm for the valves, said rocker arm being supported by said rocker shaft and driven by said cam shaft for rotatable motion about said rocker shaft, said rocker arm having a sub-rocker shaft and a pin;

a free cam follower supported by said sub-rocker shaft and driven by said cam shaft for rotatable motion about said sub-rocker shaft; and a mechanism including a lever supported by said pin of said rocker arm, said lever having a first position wherein said lever and said free cam follower are joined for attaining unitary motion of said free cam follower with said rocker arm and a second position wherein said lever and said free cam follower are separated for allowing relative motion of said free cam follower with respect to said rocker arm.

DETAILED DESCRIPTION OF THE INVENTION

Figure 1:
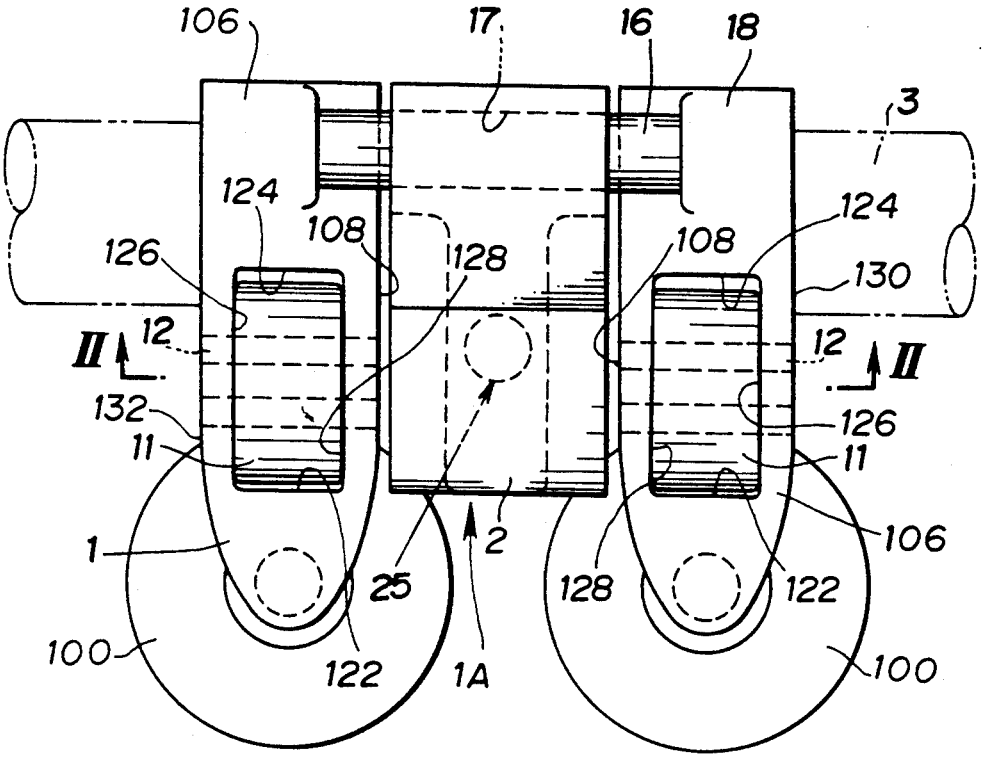
FIG. 1 is a fragmentary top plan view of an engine, with a cam shaft removed to show a major portion of a first embodiment of an apparatus for actuating valves of the engine according to the present invention.

Referring to the accompanying drawings, FIGS. 1 to 4 show the first embodiment, while FIGS. 5(A) to 8 show the second embodiment. Like reference numerals and characters are used through the Figures to designate like or similar parts. In these embodiments, the invention is embodied with an engine having per cylinder two valves with the same function, e.g., two intake valves or two exhaust valves.

Figure 2:
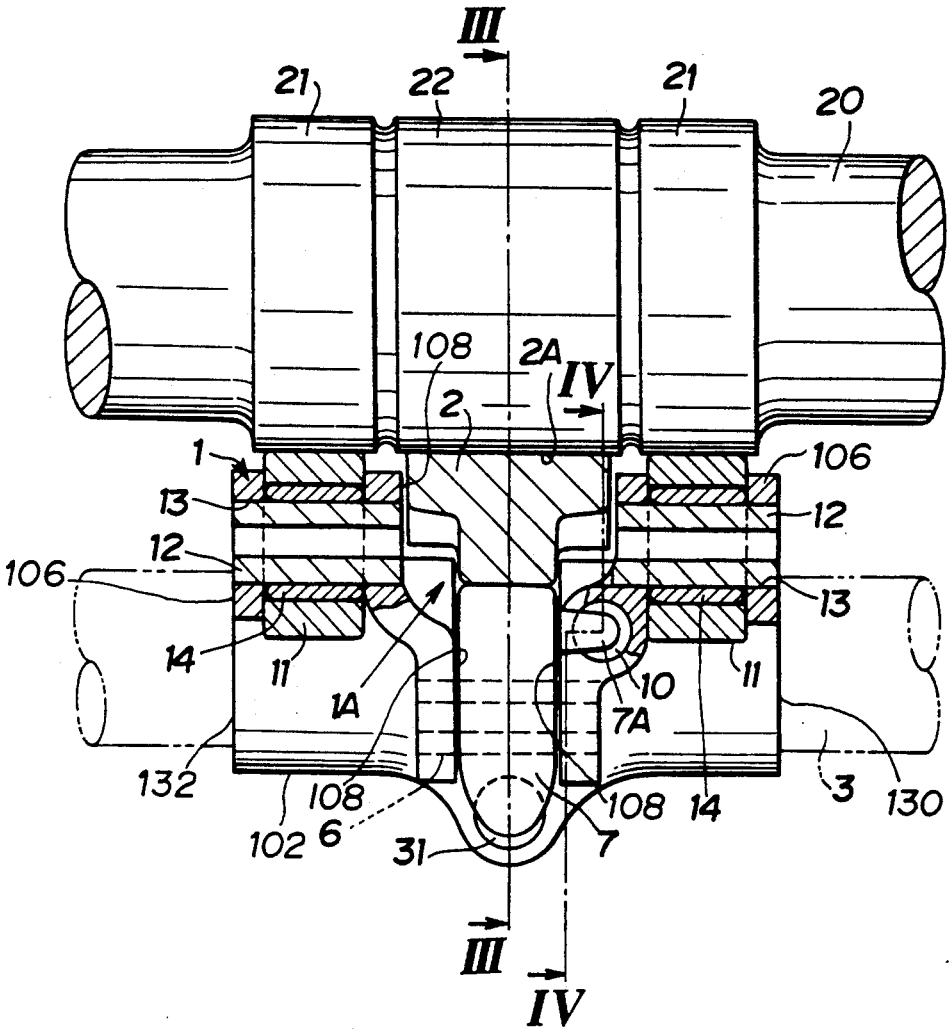
FIG. 2 is a section taken through the line II—II of FIG. 1, showing the apparatus with the cam shaft.

In FIG. 1, there are shown two poppet type intake valves 100 which are arranged for each of cylinders of an internal combustion engine. Referring also to FIG. 2, a rocker arm 1 includes a base portion 102 supported by a main rocker shaft 3 shown in phantom line and driven by two axially spaced low speed cams 21 of a cam shaft 20 for rotatable motion about the axis of the main rocker shaft 3. The main rocker shaft 3 and the cam shaft 20 are arranged in parallel and mounted to a cylinder head of the engine.

Figure 3:
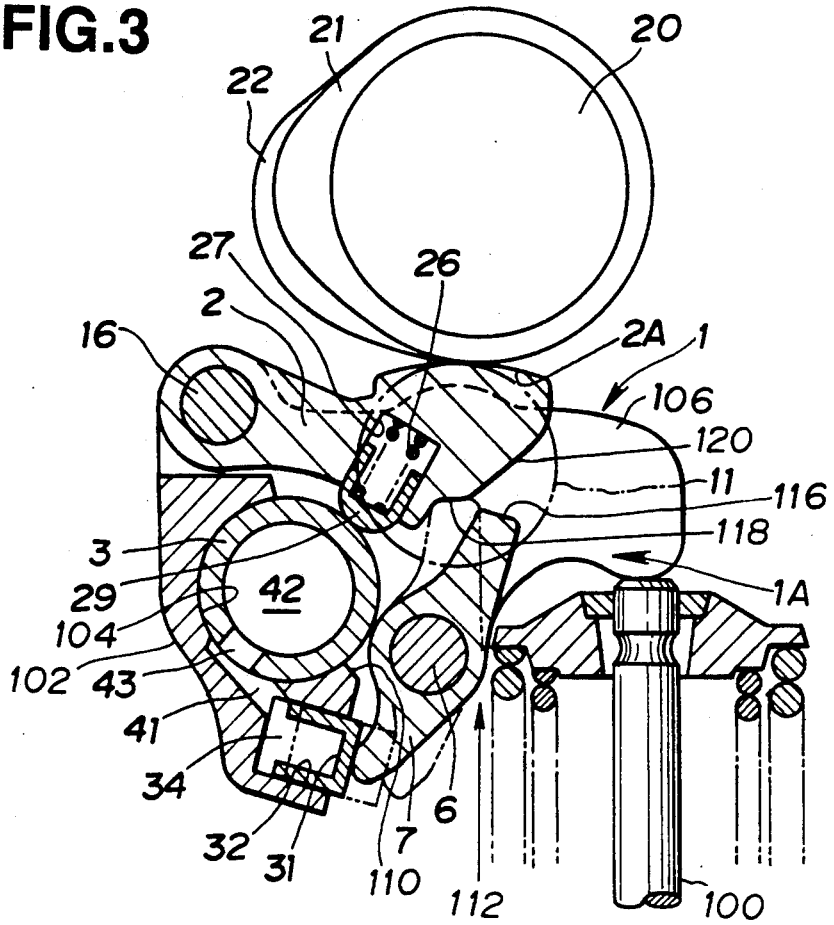
FIG. 3 is a section taken through the line III—III of FIG. 2.

As best seen in FIG. 3, the rocker arm 1 has a sub-rocker shaft 16 and a pin 6. The sub-rocker shaft 16 and the pin 6 extend in parallel with respect to the main rocker shaft 3 and disposed around the main rocker shaft 3. The main rocker shaft 3 is hollowed to define a hydraulic fluid passage 42.

Figure 4:
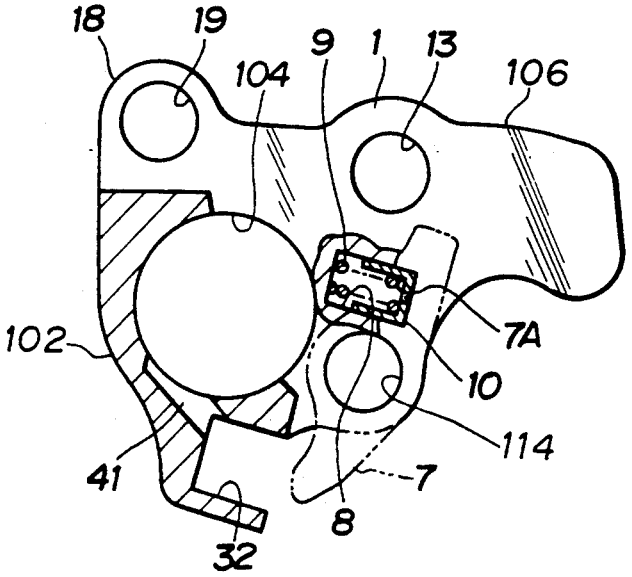
FIG. 4 is a section taken through the line IV—IV of FIG. 2, with unnecessary parts removed to show a return spring biasing a lever.
Figure 5:
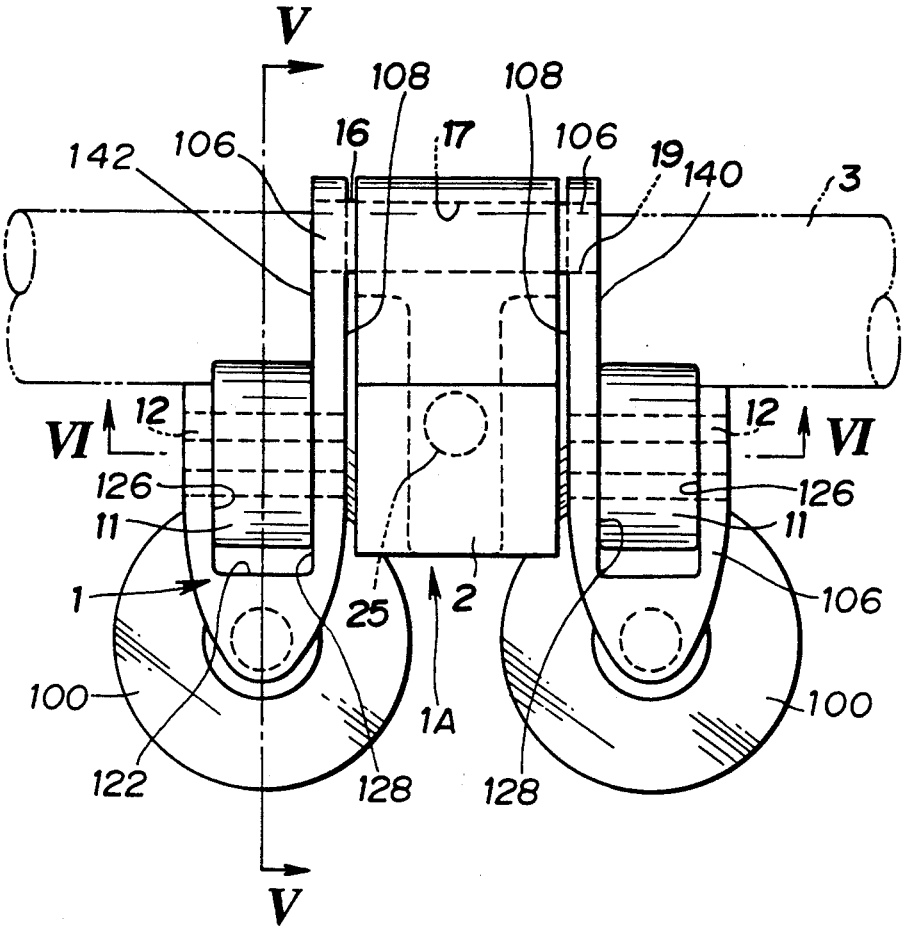
FIG. 5(A) is a similar view to FIG. 1, showing a second embodiment of an apparatus according to the present invention.
FIG. 5(B) is a section taken through the line V—V of FIG. 5(A), with unnecessary parts removed to show a peripheral wall of a radially extending portion and a base portion of a rocker arm.
Figure 5:
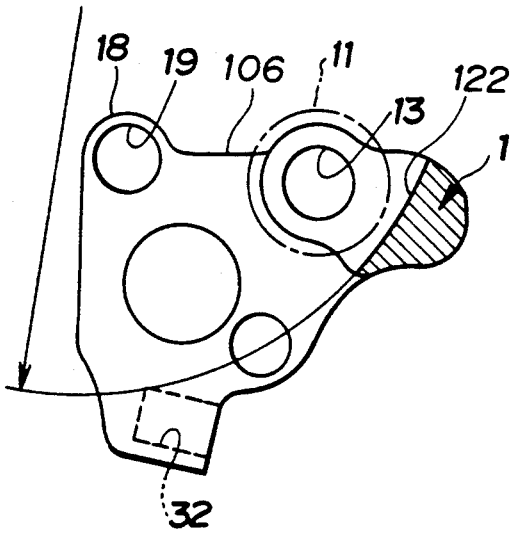

As readily seen from FIGS. 2 to 4, the base portion 102 of the rocker arm 1 is formed with a bore 104 through which the main rocker shaft 3 extends. As seen in FIGS. 1 and 4, the rocker arm 1 has a pair of radially extending, with respect to the main rocker shaft 3, portions 106 for operative engagement with the valves 100, respectively. The pair of radially extending portions 106 have axially spaced and opposed wall structures 108 defining therebetwen a space 1A (see FIGS. 1 and 2).

Disposed in the space 1A is a free cam follower 2 which is supported by the sub-rocker shaft 16. The free cam follower 2 is driven by a high speed cam 22 of the cam shaft 20 for rotatable motion about the sub-rocker shaft 16. The sub-rocker shaft 16 has opposite end portions fixedly received in bores 19 with which the pair of radially extending portions 106 (see FIGS. 1 and 4) are formed.

As best seen in FIG. 3, the base portion 102 of the rocker arm 1 is formed with a window opening 110 allowing the main rocker shaft 3 to extend into the space 1A. The free cam follower 2 includes a prop 29 supporting the free cam follower 2 on that portion of the main rocker shaft 3 which extends into the space 1A. The prop 29 is retractable to provide a lost motion connection between the free cam follower 2 and the rocker shaft 3. Specifically, the prop 29 is slidably received in a bore 27 of the free cam follower 2 and arranged for slidable contact with the main rocker shaft 3. The prop 29 also includes a lost motion spring 26 disposed in the bore 27 and acting between the prop 29 and the blind end of the bore 27 for biasing the prop 29 against the main rocker shaft 3.

Referring to. FIGS. 2 and 3, a mechanism 112 is shown which is shiftable to attain unitary motion of the free cam follower 2 with the rocker arm 1 or to allow relative motion of the free cam follower 2 with respect to the rocker arm 1. The mechanism 112 includes a lever 7 rotatably supported by the pin 6. The pin 6 has opposite end portions fixedly received in bores 114 (see FIG. 4) with which the pair of radially extending portions 106 are formed. As best seen in FIG. 4, the mechanism 112 includes a return spring 9 biasing the lever 7 toward a spring set position as illustrated by the fully drawn line in FIG. 3. The return spring 9 is disposed in a bore 8 with which one of the radially extending portions 106 of the rocker arm 1 is formed as shown in FIGS. 2 and 4. Slidably received in the bore 8 is a spring retainer 10. The return spring 9 acts between the blind end of the bore 8 and the spring retainer 10. Thus, under the bias of the return spring 9, the spring retainer 10 pushes a laterally extending ear 7A of the lever 7, exerting a force to the lever 7 in a clockwise direction, viewing in FIG. 3 toward the spring set position. As best seen in FIG. 3, the mechanism 112 also includes a hydraulic piston 31 acting on a lower end portion, viewing in FIG. 3, of the lever 7. The hydraulic piston 31 is slidably received in a bore 32 with which the base portion 102 of the rocker arm 1 is formed. The base portion 102 is formed also with a hydraulic fluid passage 41 having one end connected to the bore 32 and an opposite end connected to the bore 104. The rocker shaft 3 is formed with a radial port 43 establishing fluid communication between the hydraulic passage 41 and the hydraulic fluid passage 42 within the rocker shaft 3. The hydraulic piston 31 defines within the bore 32 a hydraulic fluid chamber 34.

Supplied to the hydraulic fluid passage 42 is a hydraulic fluid under pressure discharged by a pump. Supply of hydraulic fluid to and discharge thereof from the hydraulic fluid passage 42 is controlled by a two-position shift valve, not shown, operated by a solenoid that is energized in response to an output signal of a control unit. The shift valve has a first position wherein the hydraulic fluid is discharged from the hydaulic fluid passage 42 and the hydraulic fluid chamber 34 and a second position wherein the hydraulic fluid is supplied to the hydraulic fluid passage 42 and the hydraulic fluid chamber 34. Thus, the hydraulic fluid pressure within the hydraulic fluid chamber 34 increases from a low level to a high level owing to this shift. Supplied to the control unit are an engine speed signal, an engine coolant temperature signal, a lubricant temperature signal, a signal indicative of charging operation by a turbo charger, a throttle valve position signal, and etc. The control strategy followed by the control unit is such that the hydraulic fluid is supplied to the hydraulic fluid chamber 34 during high speed engine operation.

Referring back to FIG. 3, the hydraulic piston 31 assumes a retracted position as illustrated in the fully drawn line owing to the action of the lever 7 biased by the return spring 9 when the hydraulic fluid is discharged from the hydraulic pressure chamber 34. As the hydraulic fluid is supplied to the hydraulic fluid passage 42, the hydraulic fluid pressure withih the hydraulic pressure chamber 34 increases from the low level to the high level. This increase in hydraulic fluid pressure causes movement of the hydraulic piston 31 from the retracted position toward a projected position as illustrated by the phantom line in FIG. 3. This movement of the hydraulic piston 31 causes a counterclockwise rotation of the lever 7 from the fully drawn spring set position toward a locking position as illustrated by the phantom line in FIG. 3. Thus, the hydraulic piston 31 acts on the lever 7 for urging the lever 7 toward the locking position against the return spring 9.

As best seen in FIG. 3, the cam follower 2 is recessed toward the prop 29 for catching an upper end 116, viewing in FIG. 3, of the lever 7 to allow the lever 7 to keep the locking position. Specifically, the free cam follower 2 is recessed to define a ceiling wall 118. The ceiling wall 118 is arranged and extends in such a manner as to abut the upper end 116 of the lever 7 to provide a positive motion connection between the free cam follower 2 and the lever 7 for unitary motion of the free cam follower 2 with the rocker arm 1 when the lever 7 assumes the locking position. In order to eliminate or at least reduce disturbance of the rotatable motion of the free cam follower 2 relative to the rocker arm 1 in the case where the lever 7 fails to shift into the locking position owing to an insufficient pressure build-up in the hydraulic pressure chamber 34, the free cam follower 2 has a guide slope 120 (see FIG. 3). The angle of this slope 120 is determined such that the slope 120 slides on the upper end portion of the lever 7 without applying any substantial stress to the lever 7 during relative rotational motion of the free cam follower 2 owing to the high speed cam 22.

Referring to FIG. 2, the two axially spaced low speed cams 21 and the high speed cam 22 disposed between the two low speed cams 21 are formed integrally with the cam shaft 20. The low speed cams 21 have a cam profile designed to meet demands during engine, operation at low speeds, while the high speed cam 22 has a cam profile designed to meet demands during engine operation at high speeds. The cam profiles are determined taking into account the requirements for a valve opening period and a valve lift. Specifically, the valve opening period and/or valve lift provided by the cam profile of the high speed cam 22 are greater than that of the low speed cams 21. In this embodiment, as best seen in FIG. 3, the high speed cam 22 provides a valve lift and a valve opening period which are greater than their counterparts provided by the low speed cams 21.

Referring also to FIG. 1, the radially extending portions 106 of the rocker arm 1 rotatably support rollers 11 in rolling contact with the low speed cams 21, respectively, while the free cam follower 2 has a follower surface 2A in slidable contact with the high speed cam 22.

As readily seen from FIGS. 1 and 2, each of the radially extending portions 106 is formed with a rectangular opening, viewing in FIG. 1, receiving the roller 11 and has two spaced side walls 122, 124 and two axially, with respect to the axial of the main rocker shaft 3, spaced end walls 126, 128. The two axially spaced end walls 126, 128 are interconnected and axially spaced by the two spaced side walls 122, 124 to deine the rectangular opening.

Each of the rollers 11 are rotatbly supported via a needle bearing 14 by a bearing shaft 12 having their ends fixedly inserted into a through hole 13 drilled through the corresponding axially spaced end walls 126, 128 (see FIG. 2).

As best seen in FIG. 2, the base portion 102 of the rocker arm 1 extends between and defined by the remotest peripheral walls 130, 132 of the radially extending portions 106.

During engine operation at low speeds, the lever 7 takes the spring set position as illustrated in FIG. 3. In this position, the motion of the rocker arm 1 follows the cam profile of the low speed cams 21, since the motion of the free cam follower 2 due to the cam profile of the high speed cam 22 is absorbed by compression of the lost motion spring 26 of the retractable prop 29. Thus, rotatable motion of the free cam follower 2 relative to the rocker arm is allowed, without any disturbance of the motion of the rocker arm 1.

During engine operation at high speeds, the lever 7 takes the locking position as illustrated by the phantom line in FIG. 3, since the hydraulic piston 31 is projected owing to the pressure build-up in the hydraulic pressure chamber 34 to urge the lever 7 toward the locking position. In this position, unitary motion of the free cam follower 2 with the rocker arm 1 is attained. Since the cam profile of the high speed cam 22 provides a higher valve lift and a longer valve opening period as compared to the low speed cams 21, the roller 11 disengages from the low speed cams 21 during rotatable motion of the free cam follower 2 owing to the high speed cam 22. The motion of the free cam follower 2 is transmitted to the lever 7, the pin 6 and the radially extending portions 106 of the rocker arm 1. The state of the lost motion spring 26 remains unchanged during this motion of the free cam follower 2.

Referring to FIGS. 5(A), 5(B), 6 to 8, the second embodiment is explained. This embodiment is substantially the same as the first embodiment. However, the apparatus shown in these Figures is improved over the first embodiment in the use of a low weight rocker arm, and the design of a prop which minimizes sliding friction between a high speed cam and a free cam follower during its motion relative to the rocker arm.

Figure 6:
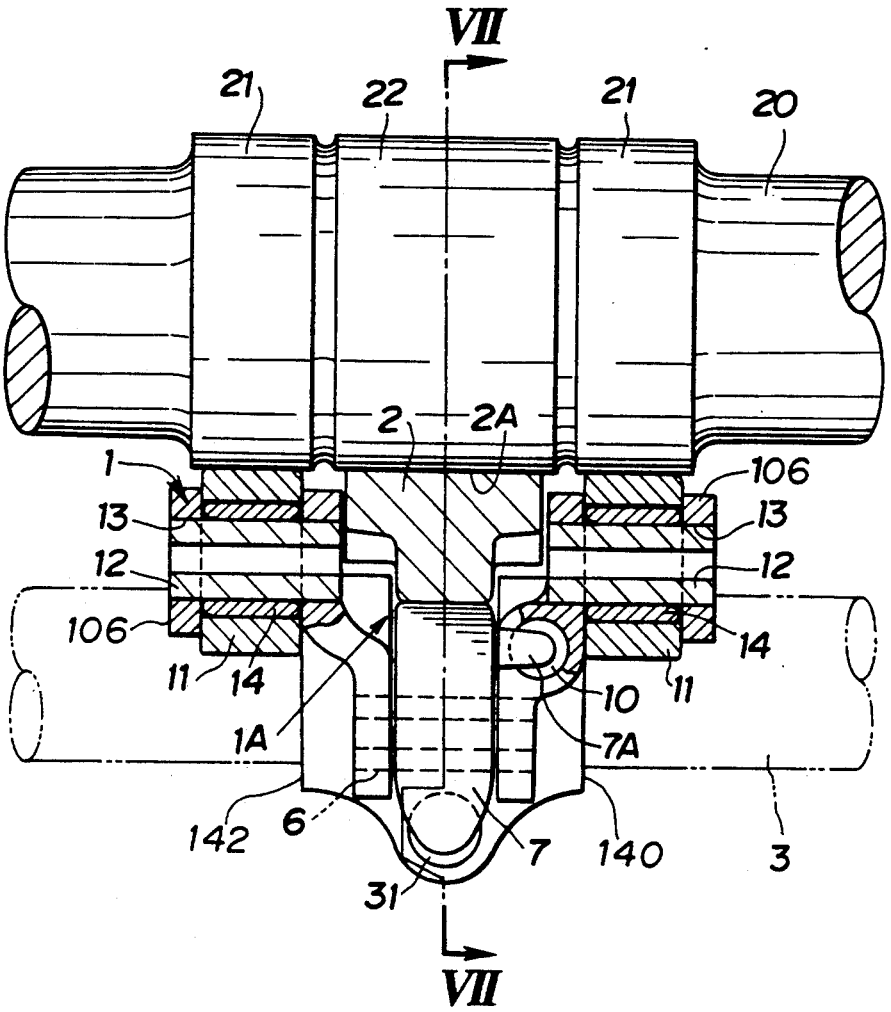
FIG. 6 is a section taken through the line VI—VI of FIG. 5(A)

As readily seen from FIGS. 5(A) and 6, a rocker arm 1 of the light weight type includes a base portion 102 and a pair of radially extending portions 106. Each of the radially extending portions is formed with an opening receiving a roller 11 and has a side wall 122 and two axially, with respect to the axis of a main rocker shaft 3, spaced end walls 126, 128. The two axially spaced end walls 126, 128 are interconnected and axially spaced by the side wall 122 to define the opening. The radially extending portions 106 have peripheral walls 140, 142. The peripheral wall 140 of one of the radially extending portions 106 connects continuously with and shares a common flat surface with the end wall 128 thereof. In the same manner, the peripheral wall 142 of the other radially extending portion 102 connects continuously with and shares a common flat surface with the end wall 128 thereof. As best seen in FIG. 6, the base portion 102 extends between and defined by the peripheral walls 140, 142 of the radially extending portions 106. As readily seen from FIG. 5(B), the side wall 122, the axially spaced end walls 126, 128 and the peripheral wall 142 are formed by a simple cutting process by a cutter in a manner as illustrated by a part of circle and an arrow. Similarly, the side wall 122, the axially spaced end walls 126, 128 and the peripheral wall 10 are formed by the simple cutting process. This makes much contribution to manufacturing cost reduction. The width between the peripheral wall 140 and the adjacent one of walls 108 and the width between the other peripheral wall 142 and the adjacent wall 108 are considerably reduced as compared to the first embodiment. Thus, drilling operation to form bores 18 takes less time and becomes easier, contributing to manufacturing cost reduction.

Figure 8:
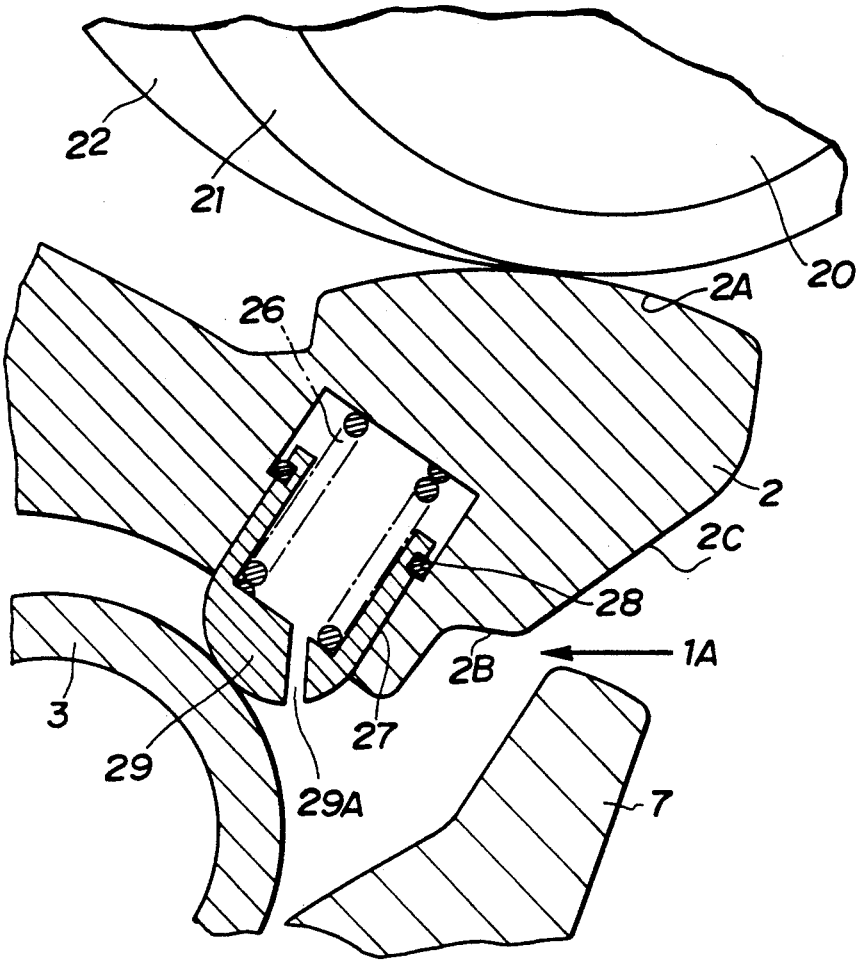
FIG. 8 is a fragmentary enlarged view of FIG. 7.

As best seen in FIG. 8, a prop 29 is formed with an air bleed hole 29A, and a stop ring 28 is received in a circumferential groove of a cylindrical portion of the prop 29. With the stop ring 28, installation of the prop 29 in a bore 27 becomes easy. With the air bleed hole 29A, reciprocal motion of the prop 29 becomes smooth, contributing to reduction in the sliding friction between a free cam follower 2 and a high speed cam 22.

With the stop ring 28, the maximum projection of the prop 29 is defined. Thus, is it possible to keep a follower surface 2A of the free cam follower 2 out of sliding contact with the base circle portion of the cam profile of the high speed cam 22 by appropriately setting the maximum projection of the prop 29. This makes much contribution to a reduction in loss owing to the sliding contact.

An air bleed hole may be formed through a spring retainer 10 of a return spring 9 for the same purpose.

Figure 7:
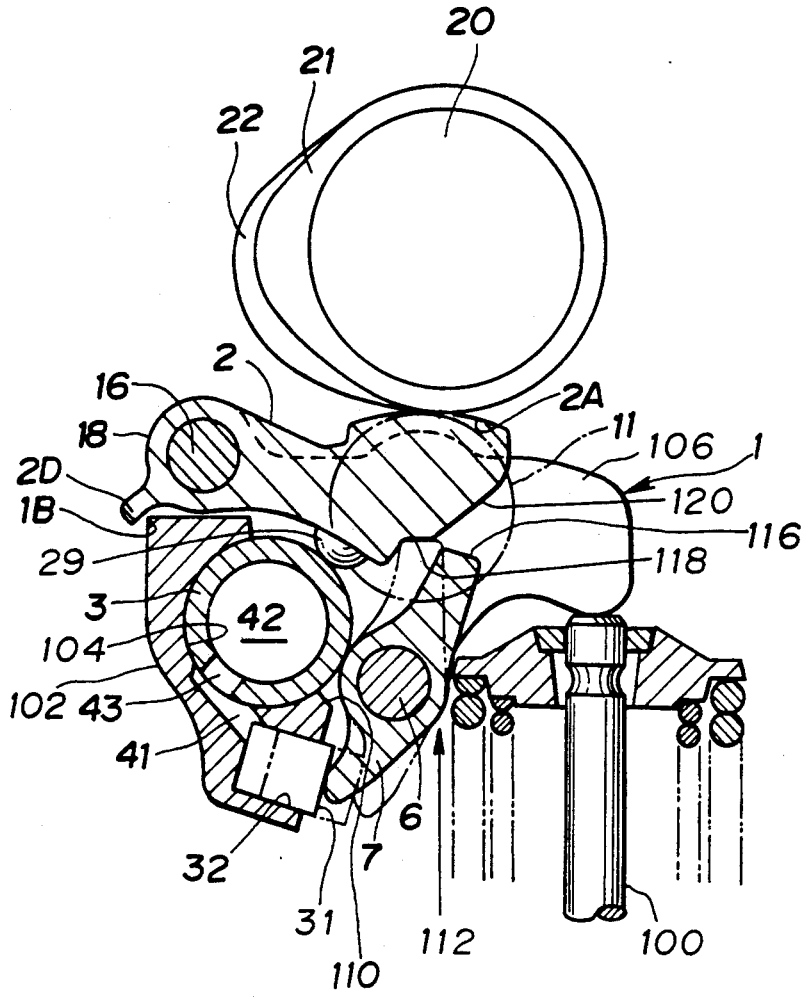
FIG. 7 is a section taken through the line VII—VII of FIG. 6.

As shown in FIG. 7, the free cam follower 2 is formed with a projection 2D which abuts an edge 1B of the rocker arm 1, thus keeping the free cam follower 2 in an appropriate position during transportation since a cam shaft 20 is removed.

From the preceding description, it is now appreciated that the lever 7 has the locking position wherein the lever 7 and the free cam follower 2 are joined for attaining unitary motion of the free cam follower with the rocker arm 1 and the spring set position wherein the lever 7 and the free cam follower 2 are separated for allowing relative motion of the free cam follower 2 with respect to the rocker arm 1.

Since the lever 7 is used, parts may be formed with less degree of precision. Adjustment of the height of the follower surface 2A of the free cam follower 2 with the height of the rollers 11 is made by replacing the lever 7 with one having different dimension. These make a reduction in assembly and cost during manufacturing.

Since it has the two radially extending portions 106 driven by the two low speed cams 21 for actuating the two valves 100, the rocker arm 1 has a great rigidity during engine operation with low speeds. Under a condition where the engine shifts into high speed operation immediately after engine starting and the pressure build-up in the hydraulic pressure, chamber 34 is slow owing to high viscosity of hydraulic fluid, the lever 7 does not reach the locking position. Thus, the rocker arm 1 is kept being driven by the low speed cams 21 at high engine speeds. However, the rocker arm 1 has sufficiently great rigidity to allow such high engine speed operation with low speed cams 21.

What is claimed is:

1. An apparatus for actuating valves of an engine, comprising:

a cam shaft with at least one set of cams;

a rocker shaft;

a rocker arm for the valves, said rocker arm being supported by said rocker shaft and driven by said cam shaft for rotatable motion about said rocker shaft, said rocker arm having a sub-rocker shaft and a pin;

a free cam follower supported by said sub-rocker shaft and driven by said cam shaft for rotatable motion about said sub-rocker shaft;

a mechanism including a lever supported by said pin of said rocker arm, said lever having a first position wherein said lever and said free cam follower are joined for attaining unitary motion of said free cam follower with said rocker arm and a second position wherein said lever and said free cam follower are separated for allowing relative motion of said free cam follower with respect to said rocker arm; and wherein said mechanism includes a return spring biasing said lever toward said second position, and wherein said mechanism includes a hydraulic piston acting on said lever for urging said lever toward said first position against said return spring.

2. An apparatus as claimed in claim 1, wherein said mechanism includes means adapted for shifting said lever between said first position and said second position.

3. An apparatus for actuating valves of an engine, comprising:

a cam shaft with at least one set of cams;

a rocker shaft;

a rocker arm for the valves, said rocker arm being supported by said rocker shaft and driven by said cam shaft for rotatable motion about said rocker shaft, said rocker arm having a sub-rocker shaft and a pin;

a free cam follower supported by said sub-rocker shaft and driven by said cam shaft for rotatable motion about said sub-rocker shaft wherein said free cam follower includes a prop supporting said free cam follower on said rocker shaft; and a mechanism including a lever supported by said pin of said rocker arm, said lever having a first position wherein said lever and said free cam follower are joined for attaining unitary motion of said free cam follower with said rocker arm and a second position wherein said lever and said free cam follower are separated for allowing relative motion of said free cam follower with respect to said rocker arm.

4. An apparatus as claimed in claim 3, wherein said prop is retractable to provide a lost motion connection between said free cam follower and said rocker shaft.

5. An apparatus as claimed in claim 4, wherein said prop is slidably received by said free cam follower and arranged for slidable contact with said rocker shaft and a lost motion spring acting between said prop and said free cam follower for biasing said prop against said rocker shaft.

6. An apparatus as claimed in claim 3, wherein said free cam follower is recessed toward said prop for catching said lever to allow said lever to keep said first position.

7. An apparatus as claimed in claim 3, wherein said lever has an end, and wherein said free cam follower is recessed to define a wall which is arranged and extends in such a manner as to abut said end of said lever to provide a positive motion connection between said free cam follower and said lever for said unitary motion of said free cam follower with said rocker arm when said lever assumes said first position.

8. An apparatus as claimed in claim 7, wherein said free cam follower has a guide slope slidably engageable with said end of said lever.

9. An apparatus as claimed in claim 3, wherein said sub-rocker shaft and said pin extend in parallel with respect to said rocker shaft and disposed around said rocker shaft.

10. An apparatus as claimed in claim 3, wherein said rocker arm has a base portion formed with a bore through which said rocker shaft extends.

11. An apparatus as claimed in claim 10, wherein said rocker arm has a pair of radially extending portions with respect to said rocker shaft for operative engagement with the valves, respectively.

12. An apparatus as claimed in claim 11, wherein said pair of radially extending portions are formed with bores receiving said sub-rocker shaft at opposite end portions thereof.

13. An apparatus as claimed in claim 12, wherein said pair of radially extending portions are formed with bores receiving said pin at opposite end portions thereof.

14. An apparatus as claimed in claim 13, wherein said pair of radially extending portions has axially spaced and opposed wall structures defining therebetween a space.

15. An apparatus as claimed in claim 14, wherein said free cam follower is disposed in said space between said axially spaced and opposed wall structures.

16. An apparatus as claimed in claim 15, wherein said lever is disposed in said space between said axially spaced and opposed wall structures.

17. An apparatus as claimed in claim 15, wherein said base portion is formed with a window opening allowing said rocker shaft to extend into said space to come into contact with said prop of said free cam follower.

18. An apparatus as claimed in claim 17, wherein said set of cams consists of a pair of axially spaced identical first cams and a second cam disposed between said first cams.

19. An apparatus as claimed in claim 18, wherein said radially extending portions rotatably support rollers in rolling contact with said first cams, respectively.

20. An apparatus as claimed in claim 19, wherein said free cam follower has a follower surface in slidable contact with said second cam.

21. An apparatus as claimed in claim 20, wherein said first cams are a low speed cam, and said second cam is a high speed cam.

22. An apparatus as claimed in claim 18, wherein each of said radially extending portions is formed with an opening receiving said roller and has two spaced side walls and two axially, with respect to said rocker shaft, spaced end walls, said two axially spaced end walls being interconnected and axially spaced by said two spaced side walls to define said opening.

23. An apparatus as claimed in claim 18, wherein each of said radially extending portions is formed with an opening receiving said roller and has a side wall and two axially, with respect to said rocker shaft, spaced end walls, said two axially spaced end walls being interconnected and axially spaced by said side wall to define said opening.

24. An apparatus as claimed in claim 23, wherein each of said radially extending portions has a peripheral wall connecting continuously with and sharing a common flat surface with one of said two axially spaced end walls which is disposed adjacent said space receiving said free cam follower.

25. An apparatus as claimed in claim 24, wherein said base portion of said rocker arm extends between and defined by said peripheral walls of said radially extending portions.

26. An apparatus for actuating valves of an engine, comprising:

a cam shaft with at least one set of cams;

a rocker arm for the valves, said rocker arm being driven by said cam shaft for rotatable motion, said rocker arm having a pin;

a free cam follower supported by said rocker arm and driven by said cam shaft for rotatable motion;

a mechanism including a lever supported by said pin of said rocker arm, said lever having a first position wherein said lever and said free cam follower are joined for attaining unitary motion of said free cam follower with said rocker arm and a second position wherein said lever and said free cam follower are separated for allowing relative motion of said free cam follower with respect to said rocker arm; and wherein said mechanism includes a return spring biasing said lever toward said second position, and wherein said mechanism includes a hydraulic piston acting on said lever for urging said lever toward said first position against said return spring.

* * * * *